United States Patent [19]

Bodine-Reese et al.

[11] Patent Number: 4,732,379

[45] Date of Patent: Mar. 22, 1988

[54] TRUCK, STABILIZATION DEVICE FOR EXERCISING/TESTING HIP ABDUCTION, ADDUCTION, FLEXION AND EXTENSION

[76] Inventors: Peggy Bodine-Reese; John W. Reese, both of 8 Brighton Ct., Gaithersburg, Md. 20877

[21] Appl. No.: 829,192

[22] Filed: Feb. 14, 1986

[51] Int. Cl.[4] ..... A63B 21/00

[52] U.S. Cl. ..... 272/125; 272/134; 272/144

[58] Field of Search ..... 272/69, 94, 125, 134, 272/138, 144, 145, 93 CAT, 129; 128/25 R, 30.2, 73, 74; 73/379

[56] References Cited

U.S. PATENT DOCUMENTS

| | | | |
|---|---|---|---|
| 2,315,485 | 4/1943 | Jones, 3rd | 272/69 |
| 3,103,357 | 9/1963 | Berne | 272/134 X |
| 3,112,928 | 12/1963 | Oswald | 272/144 X |
| 3,465,592 | 9/1969 | Perrine | 73/379 |
| 3,752,144 | 8/1973 | Weigle, Jr. | 73/379 X |
| 4,098,502 | 7/1978 | Faust | 272/134 X |
| 4,247,098 | 1/1981 | Brentham | 272/134 X |
| 4,258,913 | 3/1981 | Brentham | 272/67 |
| 4,333,340 | 6/1982 | Elmeskog | 73/379 |
| 4,462,252 | 7/1984 | Smidt et al. | 73/379 |
| 4,565,368 | 1/1986 | Boettcher | 272/125 X |
| 4,577,862 | 3/1986 | Sagedahl | 272/129 X |

FOREIGN PATENT DOCUMENTS

| | | | |
|---|---|---|---|
| 1500390 | 9/1967 | France | 128/25 R |

OTHER PUBLICATIONS

"Isolated-Joint Testing & Exercise . . . A Handbook for Using Cybex II and the U.B.X.T TM", Cybex, 2100 Smithtown Ave., Ronkonkoma, N.Y., 11779, 1980.

*Primary Examiner*—Richard J. Apley
*Assistant Examiner*—David Bender
*Attorney, Agent, or Firm*—Epstein & Edell

[57] ABSTRACT

A trunk stabilization device permits a standing user/-subject to exercise and test hip abduction, adduction, flexion and extension with a conventional muscle exercise and testing machine such as the Cybex II system. A T-bar includes a vertical stem and two adjacent horizontal cross pieces. The stem is secured to the torque transducer unit associated with the machine such that the cross pieces extend horizontally and parallel to the torque axis of the transducer at a location between the transducer and the system support frame. A truck pad, preferably provided as part of the basic machine, is alternatively mountable in two mutually perpendicular and vertical orientations at an end of the cross piece. In one orientation the truck supporting surface is parallel to the torque axis; in the other orientation the axis and trunk supporting surface are mutually perpendicular. In the first orientation, the user, by bracing his/her trunk against the pad, is able to test/exercise hip flexion and extension by pushing/pulling on the transducer actuator with the front of his/her thigh. In the second orientation, the user is able to exercise/test hip abduction/adduction by pushing/pulling with the outside of the thigh in contact with the actuator.

20 Claims, 9 Drawing Figures

TRUCK, STABILIZATION DEVICE FOR EXERCISING/TESTING HIP ABDUCTION, ADDUCTION, FLEXION AND EXTENSION

BACKGROUND OF THE INVENTION

1. Technical Field

The present invention relates to exercise and test apparatus for hip abduction, adduction, flexion and extension. More particularly, the present invention relates to a trunk stabilization device, for use with an existing exercise/test machine, that permits the desired muscles to be exercised/tested without interference from other muscles. In the particular embodiment described herein, the stabilization device is adapted for use with the Cybex II machine.

2. Description of the Prior Art

The generally accepted measurement criterion for the maximum tension which can be exerted by a muscle is the maximum moment of force that a muscle can exert on a body part. This is referred to as the maximum strength of the muscle and is expressed, for example, in kilograms per square centimeter of transverse section. In order to be meaningful, this measurement parameter must be expressed relative to the length of the muscle or the position of the body part. Several factors influence the validity of muscle strength tests. First, the muscle or muscle groups to be tested must be isolated from muscles which may contribute a moment to the measurement apparatus. This is accomplished by positioning the subject appropriately and stabilizing the parts of the body containing muscles which are not part of the measurement. Second, the moment or torque measuring device must be oriented perpendicular to the moment arm of the body. The measuring device must also operate in the plane of motion of the body. This requires a reasonable estimate of the axis of rotation of the body part involved.

Strength measurements should be taken at a proportional distance from the axis of rotation of the body part comparing measurements from different subjects. This is particularly important when the force exerted by the body part is the parameter to be measured. With respect to this methodology, moment measurements should also be taken at a proportional distance from the axis of rotation.

A widely used device for measuring strength and endurance of human muscles is a torque transducer called Cybex II, manufactured by Cybex, a division of Lumex, Inc., of Bay Shore, N.Y. This device is described in various catalogs printed by the manufacturer and also in U.S. Pat. No. 3,465,592 to Perrine, which patent is expressly incorporated herein, in its entirety, by this reference. In the Cybex II apparatus, muscular strength and endurance are measured as a function of the torque or moment applied by muscular exertion required to rotate an actuator shaft about its axis. The Cybex II is a passive component and does not apply force to the subject; it merely measures the torque applied to the device by the subject. A speed control unit permits the maximum rate of angular displacement of the input shaft to be set from zero degrees per second to two hundred ten degrees per second. When the speed control is set at zero degrees per second, the subject is able to apply torque to the input shaft but the input shaft does not rotate. This configuration is used to measure isometric strength of the muscle involved. When the speed control is set at values greater than zero degrees per second, the input shaft rotates, in response to applied torque from the subject, to a range of motion at a constant velocity for as long as the subject applies torque to the system. This latter configuration is employed to measure the concentric strength and muscular endurance of the subject.

The Cybex II is somewhat useful in exercising/testing hip abduction and hip flexion but is not at all useful for exercising/testing hip adduction and extension. One reason for this is that the user/subject is prone during the test and in a position to leverage his/her body weight to "lean into" the actuator with more than the muscles of interest. In addition, because of the capability of using body leverage, the subject can readily apply more torque to the torque transducer than it can safely accept, therby creating the possibility of permanent damage to the machine. For this reason, Cybex does not guarantee the proper functioning of the Cybex II for hip extension and adduction tests. Of course, testing hip flexion, extension, abduction and adduction while the subject is prone is also very unrealistic since such movements are rarely, if ever, attempted while prone. However, these muscular movements cannot be accurately exercised/tested on a Cybex II when the subject is standing upright because there is no means for stabilizing the subject's trunk to assure that only the muscles of interest are tested/exercised.

OBJECTS AND SUMMARY OF THE INVENTION

It is therefore a primary object of the present invention to provide an apparatus for use with the Cybex II machine to permit testing/exercising of hip abduction, adduction, flexion and extension while the user/subject is standing upright.

It is a more general object of the present invention to provide apparatus for stabilizing a user's trunk to permit testing/exercising of hip abduction, adduction, flexion and extension while the subject is standing upright.

In accordance with the present invention, an adaptor is connected to the torque transducer of the Cybex II system by mounting it on an elongated horizontal bar by which the transducer is positionally secured to the system support frame. The preferred adaptor takes the form of a T-bar having a vertical stem and a cross piece. The vertical stem has its lower end secured to the horizontal bar and its upper end secured to the cross piece. A distal end of the cross piece is capable of being secured to a pad, such as the table extension pad supplied as an accesory with the Cybex II system. That pad includes a pad support with a first portion extending perpendicularly rearward from the pad and a second portion disposed at right angles to the first portion. In one orientation of the pad the second portion of the pad support is telescopically engaged in the distal end of the cross piece such that the torque axis of the transducer is parallel to the vertical support surface of the pad. The user can then brace his/her trunk, back first, against the pad support surface and then test/exercise hip flexion and extension with the front of his/her thigh contacting the transducer actuator. In a second orientation of the pad, a connector has one part in telescopic engagement with the cross piece of the adaptor and the other part in telescopic engagement with the second portion of the pad support. In this orientation, the trunk support surface is again vertical but perpendicular to the initial orientation so that the outside of the user's thigh abuts the transducer actuator. By raising and lowering his/her leg sideways against the resistance of the transducer, the user can test/exercise his/her abduction and adduction, respectively, while his/her trunk is braced against the pad. For both orientations of the pad, the torque axis can be vertically aligned with the user's hip joint by raising/lowering the transducer. Nominal horizontal alignment of the torque axis and hip joint is effected by the pad position.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DESCRIPTION OF THE PREFERRED EMBODIMENTS

Figure 1:
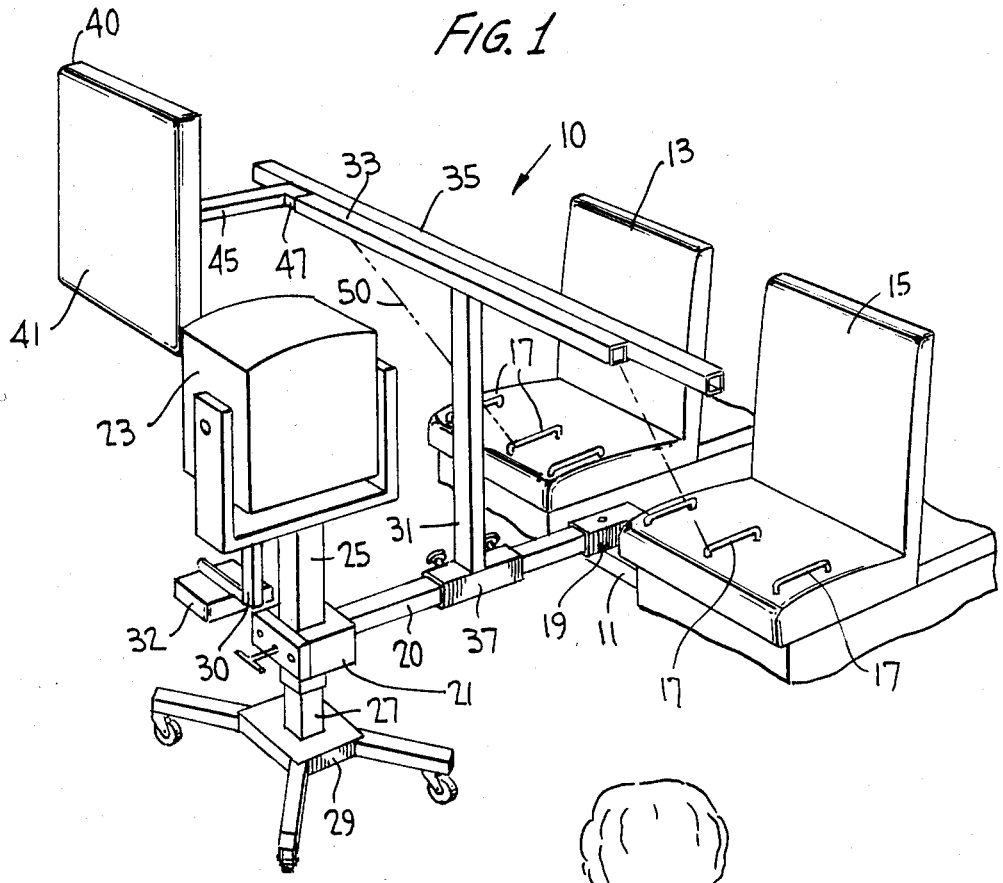
FIG. 1 is a view in perspective from the front of the trunk stabilization adaptor of the present invention secured to a muscle exercising/testing machine in a flexion/extension orientation.
Figure 2:
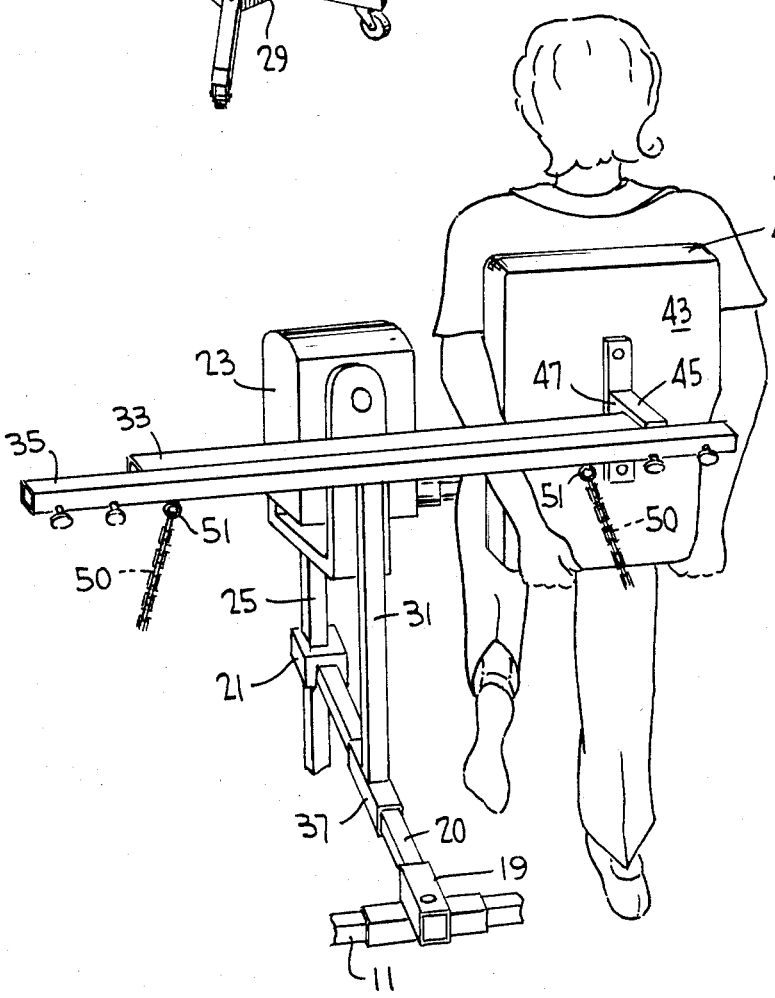
FIG. 2 is a view in perspective from the rear of a portion of the apparatus illustrated in FIG. 1 showing a user/subject in the process of a hip flexion movement.
Figure 3:
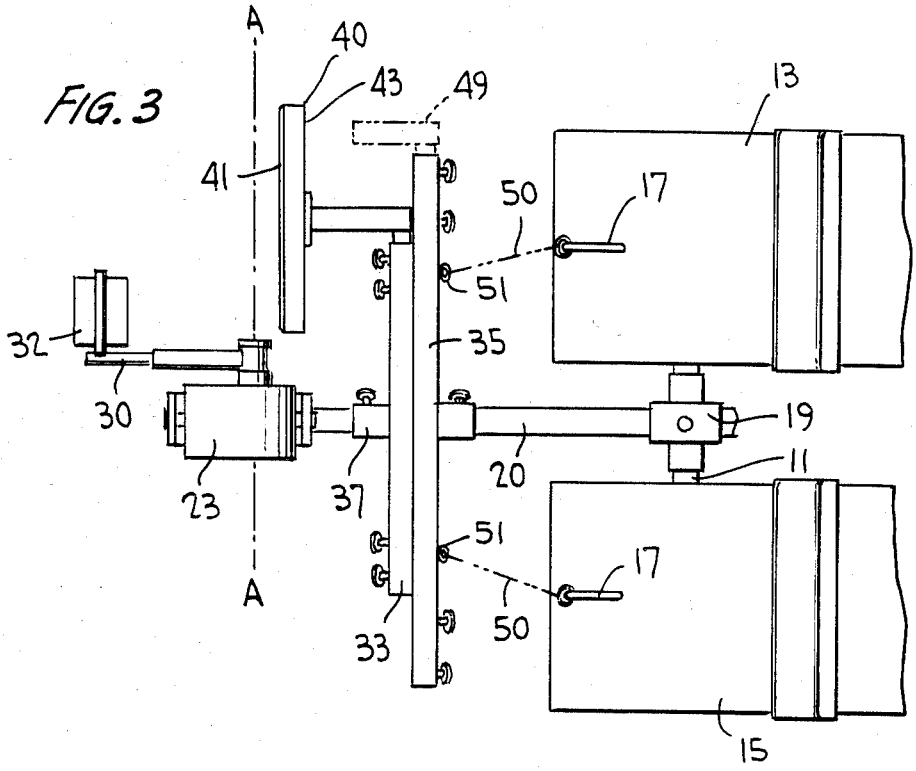
FIG. 3 is a top view in plan of the apparatus of FIG. 1 showing the adaptor in the flexion/extension orientation.

Referring to the accompanying drawings in greater detail, the stabilization adaptor of the present invention is generally designated by the reference numeral 10 and is shown deployed in conjunction with the above-mentioned Cybex II system. That system includes a floor-supported support frame 11 on which two transversely-spaced collapsible seats 23, 15 are mounted. Each seat has a plurality of transversely-spaced, slightly upraised thigh stabilization strap mounting brackets 17 disposed at the forward end of the seat. A transversely-extending portion of frame 11, disposed between seats 13, 15, has a hollow cross clamp 19 secured thereto and is adapted to slidably receive and secure a longitudinally-extending tube 20. This tube is secured to the pedestal column clamp 21 of a torque transducer 23, also referred to as a dynamometer in Cybex literature and on the face of the transducer. Clamp 21 engages a vertical tube 25 which, with telescopically engaged tube 27, constitutes a pedestal column for the torque transducer 23. More specifically, tube 27 has its lower end secured to a wheel-based pedestal 29 and is telescopically slidable through the lower end of tube 25. The upper end of tube 25 supports the torque transducer instrument 23. Clamp 21 serves the purpose of securing tubes 25 and 20 together at different mutual positions and to place the transducer 23 at a desired height. The transducer instrument includes an actuator 30 rotatable about the torque axis A—A of the instrument. The remote end of the actuator 30 is illustrated with the Cybex thigh stabilization pad 32 secured thereto. Transducer 23 is pivotable within a yoke or frame to change the angular orientation of the torque axis in a vertical plane. For purposes of using the present invention, the torque axis is oriented horizontal, parallel to the transverse dimension of the machine frame 11, and at a height corresponding to the height of the user's hip joint (as described below).

The components described above, except for adaptor 10, are all parts of the Cybex II system and, of themselves, do not constitute part of the present invention other than providing parts of the machine with which the present invention is used. Adaptor 10 serves to permit the Cybex II to be used to exercise/-test hip abduction, adduction, flexion and extension of a standing subject/user. To achieve this the adaptor 10 takes the form of a T-bar having a vertically-extending first section or stem portion 31 and a second section or cross piece. The cross piece, in the preferred embodiment, includes two hollow cross bars 33, 35 secured to and extending perpendicularly and symmetrically from the top end of stem portion 31. Cross bars 33, 35 are joined together in a mutually parallel abutting relation.

Adaptor 10 is positionally secured to the Cybex II by a connection in the form of a hollow sleeve clamp 37 rigidly secured to the bottom of stem portion 31. Sleeve clamp 37 is slidably engaged on tube 20 and can be secured at any point along that tube by tightening the clamp. Thus, the longitudinal position of adaptor 10 relative to support frame 11 (i.e., in the front-to-back dimension) is adjustable. However, the relative transverse position is fixed.

Cross bar 33 is shorter than cross bar 35 at both ends of the cross piece. Both cross bars have hollow cross-sections dimensioned to permit them to telescopically receive accessories of the Cybex II and its adjunct, the U.B.X.T. (Upper-Body Exercise and Testing Table). In particular, the cross piece is configured to engage the Cybex table extension pad 40. This pad includes a front or supporting surface 41 and a rear surface 43. In utilizing the present invention the supporting surface 41 is adapted to be placed against the trunk (front or back first, depending upon the test mode) of a user/subject. The rear surface 43 has a support bracket extending therefrom in the form of a right angle tube including a first part 45 and a second part 47. The first part 45 of the bracket extends perpendicularly from rear surface 43; the second part 47 extends at right angles to the first part in spaced, parallel relation to the rear surface 43 and terminates beyond the periphery of the pad 40.

In the hip flexion/extension mode of testing/exercising, as illustrated in FIGS. 1, 2, 3 and 9, part 47 of the pad support bracket is inserted into the end of short cross bar 33 toward which the torque transducer 23 faces. Screw clamps are provided at the ends of both cross bars 33, 35 so that inserted tubes, such as part 47, can be secured in place. The orientation of pad 40 is such that trunk support surface 41 faces forwardly of the support frame 11, and the torque axis passes parallel to and in front of the support surface. In this position the user can brace his/her back against the trunk support surface and find the front of his/her thigh (i.e., the thigh nearest the torque transducer) proximate the thigh stabilization pad 32 secured to the remote end of the transducer actuator 30. By lifting and lowering his/her thigh against the programmed resistance of the torque transducer, and with the trunk braced against pad 40 as described, the user can exercise/test hip flexion and extension, respectively. In order to exercise/test flexion and extension of the other hip, the torque transducer 23 must be rotated 180 degrees to face the opposite end of adaptor 10. In addition, pad 40 must be inserted into the opposite end of cross bar 33. In either case, the height of the transducer 23 is adjusted until the torque axis A—A is vertically aligned with the user's hip joint. Horizontal alignment between the torque axis and the hip joint is provided by the position of sleeve clamp 37 on tube 20, which position can be adjusted as desired.

Figure 4:
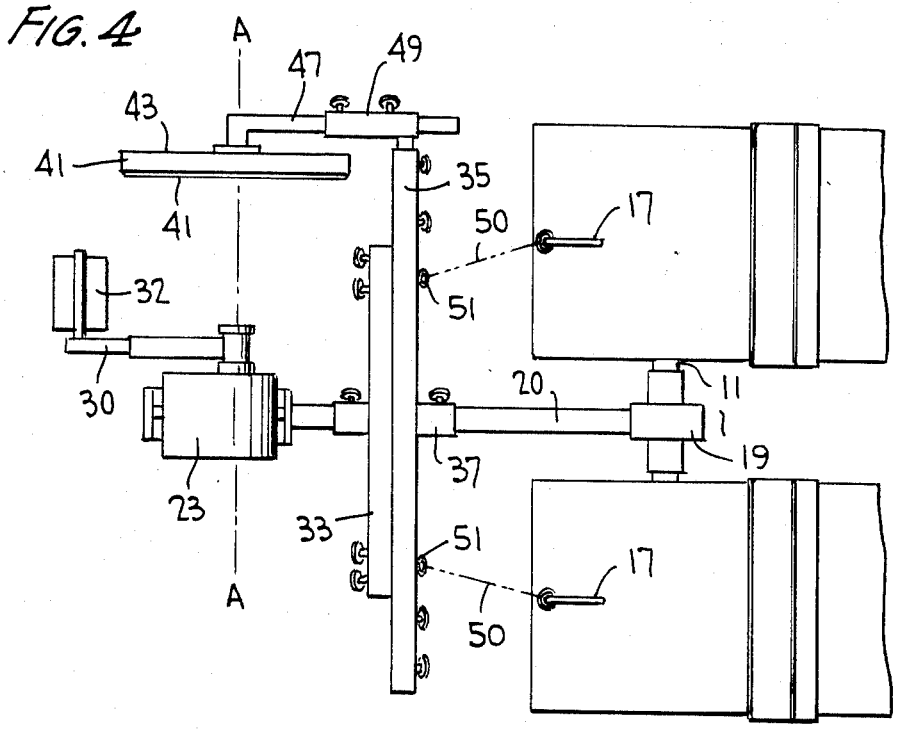
FIG. 4 is a top view in plan of the system of FIG. 1 showing the adaptor in the abduction/adduction orientation.
Figure 5:
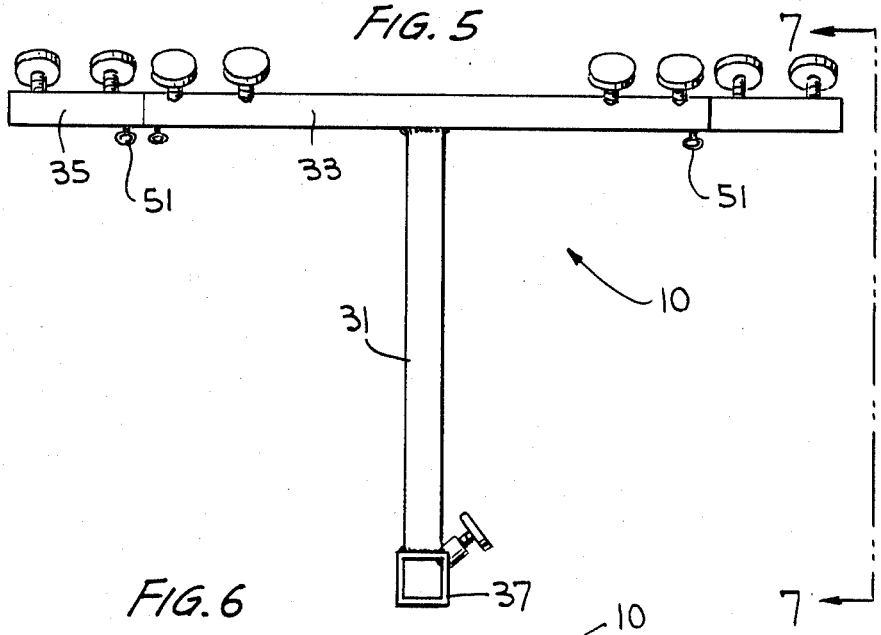
FIG. 5 is a front view in elevation of the adaptor constituting the preferred embodiment of the present invention.
Figure 6:
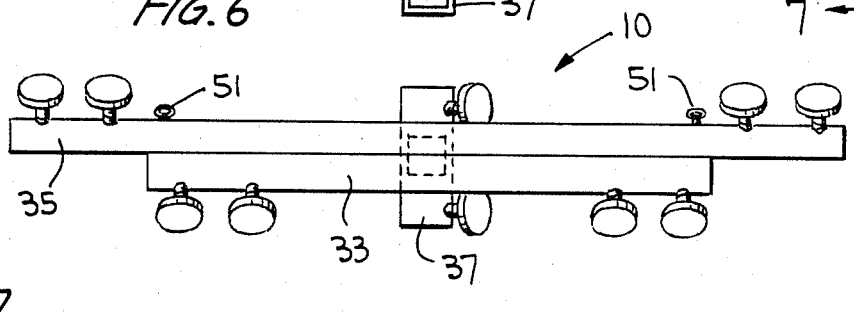
FIG. 6 is a top view in plan of the adaptor of FIG. 5.
Figure 7:
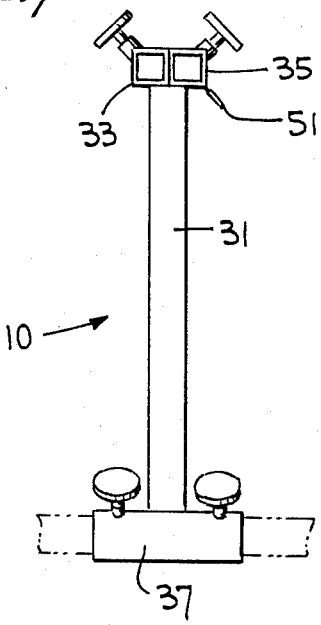
FIG. 7 is a side view in elevation of the adaptor of FIG. 5.
Figure 8:
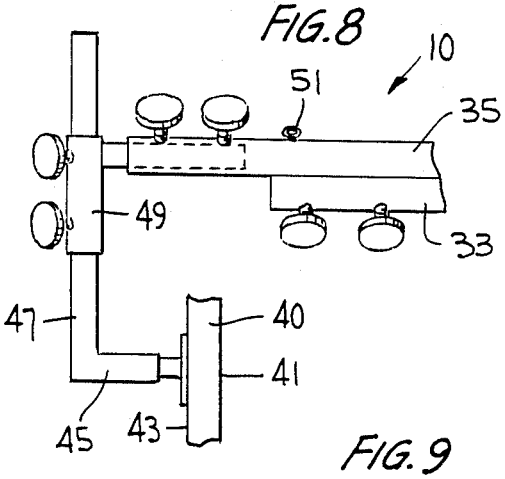
FIG. 8 is a detailed top view in plan of the portion of the system of FIG. 4 at which the support pad is connected to the adaptor in the abduction/adduction orientation.
Figure 9:
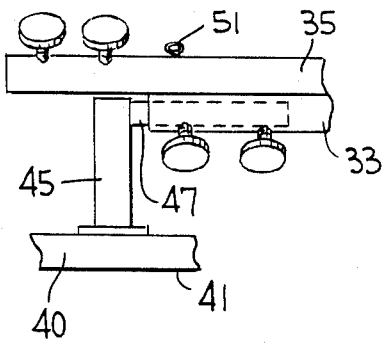
FIG. 9 is a detailed top view in plan of a portion of the system illustrated in FIG. 3 showing the connection of the support pad to the adaptor of the present invention for the flexion/extension orientation.

In order to test/exercise hip abduction and adduction, pad 40 is secured to either end of cross bar 35 with the aid of a Cybex universal adaptor 49 in a manner illustrated in FIGS. 4 and 8. Specifically, adaptor 49 has a sleeve portion to slidably receive and clampingly engage part 47 of the pad support bracket. A right angle extension of the adaptor 49 is slidably received and clampingly engaged in the end of cross bar 35. Pad 40 can thusly be oriented perpendicular to its orientation for the flexion/extension mode (FIGS. 1, 2, 3 and 9) and is perpendicular to the torque axis A—A. The user, by bracing his or her trunk against the trunk supporting surface 41 of the pad, is positioned with the outside of his/her thigh adjacent the thigh stabilization pad 32 on actuator 30. That leg can be raised outwardly sideways (for abduction) and lowered inwardly sideways (for adduction) against the resistance of the torque transducer 23. Either leg can be tested/exercised for the same position of the pad 40 by merely changing the user's trunk bracing position against pad 40 from back-supported to abdomen-supported. If the same support position is preferred for testing/exercising both legs, pad 40 can be moved to the other end of the cross bar 35, and the transducer 23 can be rotated 180 degrees as described above.

Additional positional stability of the adaptor 10 can be provided by the use of two chains 50 extending between respective hooks 51 and respective strap mounting brackets 17 on seats 13 and 15. Hooks 51 are disposed symmetrically on cross bar 35 on opposite sides of the stem portion 31 of the adaptor.

The preferred embodiment of the present invention includes the two cross bars 33, 35 serving as a common cross piece for the adaptor 10. It should be understood, however, that a single cross bar may be so employed, if desired, since both portion 47 of the pad support clamp and the right angle extension of adaptor 49 are slidably engageable in either of tubes 33 and 35. It has been found, however, that for use with the Cybex II machine in the manner described, the two-bar approach is desirable. More particularly, for the flexion/extension mode, optimum positioning of the user/subject to present proper contact between the thigh and the actuator is achieved with the relatively shorter tube 33. On the other hand, the right angle projection of adaptor 49 provided with the Cybex II is not long enough to properly position the subject/user for the abduction/adduction mode when the right angle projection of the adaptor 49 is inserted into the shorter tube 33. Of course, if an adaptor 49 with a longer projection is provided, a single cross bar may be employed. Nevertheless, the use of two cross bars also provides additional rigidity to the structure and may be desirable in any event.

The cross-sectional configuration of the hollow cross bars 33, 35 is selected to permit the right angle projection of adaptor 49 and the elongated part 47 of the pad support bracket to be slidably received in the cross bars. The Cybex II system utilizes tubing having square cross-section; therefore, the cross bars 33 and 35 have hollow square cross-sections as required to accommodate the slidably received parts. It is to be understood that differently configured pads and adaptors would require differently configured cross bar cross-sections.

Although the present invention has been disclosed for use in conjunction with the Cybex II system, it is to be understood that the concept is applicable for use with substantially any torque transducer type of muscle exercise/test machine. The key feature is the support of a trunk-bracing pad at a position which permits a user/-subject, standing upright, to be properly oriented with respect to the torque transducer so that flexion/extension and abduction/adduction forces can be exerted in opposition to the resistance afforded by the torque transducer.

By way of example only, a specific embodiment of the present invention has been constructed and tested in conjunction with a Cybex II system and included the following dimensions. Stem portion 31 was a hollow tube having a length of twenty-two inches and a two inch square cross-section (outside dimension). Cross bar 33 was a hollow tube having a length of thirty inches and a hollow outside cross-section one and one-half inches square. Cross bar 35 had a length of forty-four inches and a hollow cross-section of one and one-half inches square. Sleeve clamp 37 was six inches in length and had a two and one-half inch square outside cross-sectional dimension. The metal and for all of the tubing was one-eighth inch thick.

From the foregoing description it will be appreciated that the invention makes available a novel adaptor for use with a muscle exercising/testing machine to permit a standing subject/user to test/exercise hip abduction, adduction, flexion and extension while stabilizing his/her trunk.

Having described the preferred embodiment of a new and improved trunk stabilization device for exercising/testing hip abduction, adduction, flexion and extension constructed in accordance with the present invention, it is believed that other modifications, variations and changes will be suggested to those skilled in the art in view of the techniques set forth herein. It is therefore to be understood that all such variations, modifications and changes are believed to fall within the scope of the present invention as defined by the appended claims.

We claim:

1. Apparatus for stabilizing the trunk of a standing user/subject while permitting exercise and testing of the user's hip abduction, adduction, flexion and extension by means of a machine for exercising/testing muscles and joints, said machine being of the type which includes a support frame, a torque transducer having an actuator and means for controllably resisting torque applied to the transducer via the actuator about a horizontally-extending torque axis, and transducer stabilizing means for positionally stabilizing the torque transducer relative to said support frame, said torque transducer including height adjustment means permitting selective raising and lowering of the torque axis, said apparatus comprising:

trunk stabilization means having a trunk supporting surface against which the front and back of the trunk of the user are to be alternatively braced when the apparatus is in use;

adaptor means for mounting said trunk stabilization means in first and second mutually perpendicular orientations of said trunk supporting surface; and connector means for positionally securing said adaptor means to the torque transducer such that the trunk supporting surface is substantially vertical in both first and second orientations, said trunk supporting surface in said first orientation being substantially parallel to said torque axis and disposed such that, with the user's trunk braced against the trunk supporting surface, the user's hip joint is coaxially alignable with said torque axis by adjustment of the height of said torque axis, and the user's thigh is positioned in proximity to the actuator to permit application of torque to the torque transducer by flexion and extension of the user's hip; said trunk supporting surface in said second orientation being substantially perpendicular to said torque axis and disposed such that, with the user's trunk braced against said trunk supporting surface, the user's hip joint is perpendicularly alignable with said torque axis by adjusting the height of said torque axis, and the user's thigh is positioned in proximity to the actuator to permit application of torque to the torque transducer by abduction and adduction of the user's hip.

2. The apparatus according to claim 1 wherein the transducer stabilizing means comprises an elongated bar secured to said support frame and said torque transducer;

wherein said adaptor means includes a first elongated section having first and second ends and a second elongated section secured to said first end of said first section and extending perpendicularly from said first section;

wherein said connector means comprises means securing said second end of said first section to said elongated bar at a location intermediate said torque transducer and said support frame with said first section extending substantially vertically and said second station extending substantially horizontally and parallel to said torque axis; and wherein said second section includes a distal end having mounting means for alternatively mounting said trunk stabilization means in said first and second orientations.

3. The apparatus according to claim 2 further comprising attachment means attached between said support frame and said second section at a location intermedaite said first section and said distal end for resisting motion of said second section due to forces exerted by bracing the user's trunk against said trunk stabilization means.

4. The apparatus according to claim 3 wherein said attachment means is a chain.

5. The apparatus according to claim 2 wherein said trunk stabilization means comprises: a pad having a front surface corresponding to said trunk supporting surface and a rear surface; and a pad support in the form of a right angle bar having a first portion extending generally perpendicularly from said rear surface and a second portion extending perpendicularly from said first portion and horizontally, in use, in spaced relation to said rear surface and terminating at a remote end beyond the periphery of said pad; and wherein said second section of said adaptor means includes: a first tube for telescopically engaging said second portion of said pad support; and clamp means for positionally securing the telescopically engaged second portion of said pad support and said first tube.

6. The apparatus according to claim 5 further comprising accessory connection means for telescopically engaging said second section of said adaptor means at said distal end, and accessory connection means including tube means for telescopically engaging said second portion of said pad support in perpendicular orientation to said second section.

7. The apparatus according to claim 5 wherein said second section of said adaptor means includes a second tube secured to and extending in adjacent parallel relation to said first tube, said second tube extending from said first section a greater distance than does the second tube, said apparatus further comprising an accessory connection including a first part for telescopically engaging said second tube and a second part for telescopically engaging and securing said second portion of said pad support in perpendicular orientation to said second tube.

8. The apparatus according to claim 7 wherein said first and second sections of said adaptor means form a T-shaped structure, said first section constituting a stem portion and said first and second tubes constituting a cross bar portion.

9. The apparatus according to claim 8 further comprising first and second chains extending from said cross bar portion at opposite sides, respectively, of said stem portion to respective anchor portions of said support frame to resist movement of said adaptor means in response to forces exerted by bracing a user's trunk against said pad.

10. The apparatus according to claim 9 wherein said cross bar portion is substantially symmetrical about said stem portion.

11. Apparatus for stabilizing the trunk of a standing user while permitting exercise and testing of the user's hip abduction, addition, flexion and extension by means of a machine for exercising and testing muscles and joints, said machine being of the type which includes: a support frame; a torque transducer having an actuator and means for controllably resisting torque applied to the transducer via the actuator about a horizontally-extending torque axis, said torque transducer including height adjustment means permitting selective raising and lowering of the torque axis; transducer stabilizing means for positionally stabilizing the torque transducer relative to the support frame; and trunk stabilization means having a trunk supporting surface against which the front and back of the trunk of the user are to be alternatively braced when the apparatus is in use, said trunk stabilization means including a pad having a front surface corresponding to said trunk supporting surface and a rear surface, and a pad support in the form of a right angle bar having a first portion extending generally perpendicularly from said rear surface and a second portion extending perpendicularly from said first portion and horizontally, in use, in spaced relation to the rear surface and terminating at a remote end beyond the periphery of said pad; said apparatus comprising:

adaptor means for mounting said trunk stabilization means in first and second mutually perpendicular orientations of said trunk supporting surface; and connector means for positionally securing said adaptor means to the torque transducer such that the trunk supporting surface is substantially vertical in both first and second orientations, said trunk supporting surface in said first orientation being substantially parallel to said torque axis and disposed such that, with the user's trunk braced against the trunk supporting surface, the user's hip joint is coaxially alignable with said torque axis by adjustment of the height of said torque axis, and the user's thigh is positioned in proximity to the actuator to permit application of torque to the torque transducer by flexion and extension of the user's hip; said trunk supporting surface in said second orientation being substantially perpendicular to said torque axis and disposed such that, with the user's trunk braced against said trunk supporting surface the user's hip joint is perpendicularly alignable with said torque axis by adjusting the height of said torque axis, and the user's thigh is positioned in proximity to the actuator to permit application of torque to the torque transducer by abduction and adduction of the user's hip.

12. The apparatus according to claim 11 wherein the transducer stabilizing means comprises an elongated bar secured to said support frame and said torque transducer;

wherein said adaptor means includes a first elongated section having first and second ends and a second elongated section secured to said first end of said first section and extending perpendicularly from said first section;

wherein said connector means comprises means securing said second end of said first section to said elongated bar at a location intermediate said torque transducer and said support frame with said first section extending substantially vertically and said second section extending substantially horizontally and parallel to said torque axis; and wherein said second section includes a distal end having mounting means for alternatively mounting said trunk stabilization means in said first and second orientations.

13. The apparatus according to claim 12 further comprising attachment means attached between said support frame and said second section at a location intermediate said first section and said distal end for resisting motion of said second section due to forces exerted by bracing the user's trunk against said trunk stabilization means.

14. The apparatus according to claim 13 wherein said attachment means is a chain.

15. The apparatus according to claim 12 wherein said second section of said adaptor means includes:

a first tube for telescopically engaging said second portion of said pad support; and clamp means for positionally securing the telescopically engaged second portion of said pad support and said first tube.

16. The apparatus according to claim 15 further comprising accessory connection means for telescopically engaging said second section of said adaptor means at said distal end, and accessory connection means including tube means for telescopically engaging said second portion of said pad support in perpendicular orientation to said second section.

17. The apparatus according to claim 15 wherein said second section of said adaptor means includes a second tube secured to and extending in adjacent parallel relation to said first tube, said second tube extending from said first section a greater distance than does the second tube, said apparatus further comprising an accessory connection including a first part for telescopically engaging said second tube and a second part for telescopically engaging and securing said second portion of said pad support in perpendicular orientation to said second tube.

18. The apparatus according to claim 17 wherein said first and second sections of said adaptor means form a T-shaped structure, said first section constituting a stem portion and said first and second tubes constituting a cross bar portion.

19. The apparatus according to claim 18 further comprising first and second chains extending from said cross bar portion at opposite sides, respectively, of said stem portion to respective anchor portions of said support frame to resist movement of said adaptor means in response to forces exerted by bracing a user's trunk against said pad.

20. The apparatus according to claim 19 wherein said cross bar portion is subtantially symmetrical about said stem portion.

* * * * *